US010273752B2

(12) United States Patent
Mebane, III

(10) Patent No.: US 10,273,752 B2
(45) Date of Patent: Apr. 30, 2019

(54) DRILLING CONTROL AND INFORMATION SYSTEM

(71) Applicant: National Oilwell Varco, L.P., Houston, TX (US)

(72) Inventor: Robert Eugene Mebane, III, Austin, TX (US)

(73) Assignee: National Oilwell Varco, L.P., Houston, TX (US)

( * ) Notice: Subject to any disclaimer, the term of this patent is extended or adjusted under 35 U.S.C. 154(b) by 520 days.

(21) Appl. No.: 14/389,482

(22) PCT Filed: Apr. 3, 2013

(86) PCT No.: PCT/US2013/035071
§ 371 (c)(1),
(2) Date: Sep. 30, 2014

(87) PCT Pub. No.: WO2013/152072
PCT Pub. Date: Oct. 10, 2013

(65) Prior Publication Data

US 2015/0053483 A1 Feb. 26, 2015

Related U.S. Application Data

(60) Provisional application No. 61/619,500, filed on Apr. 3, 2012.

(51) Int. Cl.
*E21B 7/00* (2006.01)
*E21B 44/00* (2006.01)
(Continued)

(52) U.S. Cl.
CPC ..... *E21B 7/00* (2013.01); *E21B 7/24* (2013.01); *E21B 12/02* (2013.01); *E21B 21/08* (2013.01);
(Continued)

(58) Field of Classification Search
CPC ..... E21C 25/00; E21B 7/00
See application file for complete search history.

(56) References Cited

U.S. PATENT DOCUMENTS 4,794,534 A 12/1988 Millheim
6,907,375 B2 * 6/2005 Guggari ..... E21B 47/00 340/853.2
(Continued)

FOREIGN PATENT DOCUMENTS

EP 1637695 3/2006
WO 2004090285 10/2004
(Continued)

OTHER PUBLICATIONS

Search Report and Written Opinion dated Jun. 4, 2014 for corresponding International Application No. PCT/US2013/035071 (11 pgs.).
(Continued)

*Primary Examiner* — Giovanna C. Wright
*Assistant Examiner* — Manuel C Portocarrero
(74) *Attorney, Agent, or Firm* — Jonathan M. Pierce; Porter Hedges LLP

(57) ABSTRACT

A drilling control and information system comprising: a rig site network (102) including a drilling equipment controller (112) and a drilling parameter sensor (116); a downhole sensor (118) communicatively coupled to the rig site network; a data center (104) communicatively coupled to the rig site network; a remote access site (106) communicatively coupled to the data center; and a pressure management application (300) communicatively coupled to the rig site network, wherein the pressure management application receives pressure data from the drilling parameter sensor and the downhole sensor and issues an operating instruction to the drilling equipment controller.

13 Claims, 8 Drawing Sheets

(51) Int. Cl.

| | |
|---|---|
| ***E21B 21/08*** | (2006.01) |
| ***E21B 28/00*** | (2006.01) |
| ***E21B 43/00*** | (2006.01) |
| ***E21B 44/02*** | (2006.01) |
| ***E21B 47/12*** | (2012.01) |
| ***E21B 7/24*** | (2006.01) |
| ***E21B 12/02*** | (2006.01) |
| ***E21B 45/00*** | (2006.01) |
| ***E21B 47/06*** | (2012.01) |

(52) U.S. Cl.
CPC ..... *E21B 28/00* (2013.01); *E21B 43/003* (2013.01); *E21B 44/00* (2013.01); *E21B 44/005* (2013.01); *E21B 44/02* (2013.01); *E21B 45/00* (2013.01); *E21B 47/06* (2013.01); *E21B 47/12* (2013.01)

(56) References Cited

U.S. PATENT DOCUMENTS

| | | | | |
|---|---|---|---|---|
| 8,210,283 | B1 * | 7/2012 | Benson | E21B 47/12 175/26 |
| 2003/0015351 | A1 | 1/2003 | Goldman et al. | |
| 2005/0092523 | A1 | 5/2005 | McCaskill | |
| 2005/0194182 | A1 * | 9/2005 | Rodney | E21B 47/12 175/24 |
| 2007/0256863 | A1 | 11/2007 | Hulick et al. | |
| 2009/0055029 | A1 | 2/2009 | Roberson et al. | |
| 2010/0147589 | A1 | 6/2010 | Wingky | |
| 2011/0217861 | A1 | 9/2011 | Scheibelmasser et al. | |

FOREIGN PATENT DOCUMENTS

| | | |
|---|---|---|
| WO | 2005017308 | 2/2005 |
| WO | 2009055152 | 4/2009 |
| WO | 2011035280 | 3/2011 |
| WO | 2012016045 | 2/2012 |

OTHER PUBLICATIONS

Search Report and Written Opinion dated Jun. 3, 2014 for corresponding International Application No. PCT/US2013/035072 (10 pgs.).

Search Report and Written Opinion dated Jun. 4, 2014 for corresponding International Application No. PCT/US2013/035073 (11 pgs.).

Search Report and Written Opinion dated Jun. 4, 2014 for corresponding International Application No. PCT/US2013/035074 (11 pgs.).

Search Report and Written Opinion dated Jun. 4, 2014 for corresponding International Application No. PCT/US2013/035077 (11 pgs.).

* cited by examiner

DRILLING CONTROL AND INFORMATION SYSTEM

CROSS-REFERENCE TO RELATED APPLICATIONS

This application claims benefit of International Application No. PCT/US2013/035071, filed Apr. 3, 2013, which claims priority of U.S. Provisional Patent Application No. 61/619,500, filed Apr. 3, 2012; and is related to International Application No. PCT/US2013/035072, filed Apr. 3, 2013; International Application No. PCT/US2013/035073, filed Apr. 3, 2013; International Application No. PCT/US2013/035074, filed Apr. 3, 2013; and International Application No. PCT/US2013/035077, filed Apr. 3, 2013, each of which claim priority to U.S. Provisional Patent Application No. 61/619,500, filed Apr. 3, 2012, and are and incorporated herein by reference in their entirety for all purposes.

BACKGROUND

This disclosure relates generally to methods and apparatus for drilling control and information systems. More specifically, this disclosure relates to methods and apparatus for providing drilling control and information systems that may interface with a plurality of control and information applications to support a variety of control and information functions through a common infrastructure. The common control infrastructure may be configured to acquire data from multiple sources, communicate that data with a plurality of control modules or information interfaces, and provide operating instructions to multiple drilling components.

To recover hydrocarbons from subterranean formations, wells are generally constructed by drilling into the formation using a rotating drill bit attached to a drill string. A fluid, commonly known as drilling mud, is circulated down through the drill string to lubricate the drill bit and carry cuttings out of the well as the fluid returns to the surface. The particular methods and equipment used to construct a particular well may vary extensively based on the environment and formation in which the well is being drilled. Many different types of equipment and systems are used in the construction of wells including, but not limited to, rotating equipment for rotating the drill bit, hoisting equipment for lifting the drill string, pipe handling systems for handling tubulars used in construction of the well, including the pipe that makes up the drill string, pressure control equipment for controlling wellbore pressure, mud pumps and mud cleaning equipment for handling the drilling mud, directional drilling systems, and various downhole tools.

The overall efficiency of constructing a well generally depends on all of these systems operating together efficiently and in concert with the requirements in the well to effectively drill any given formation. One issue faced in the construction of wells is that maximizing the efficiency of one system may have undesirable effects on other systems. For example, increasing the weight acting on the drill bit, known as weight on bit (WOB), may often result in an increased rate of penetration (ROP) and faster drilling but may also decrease the life of the drill bit, which may increase drilling time due to having to more frequently replace the drill bit. Therefore, the performance of each system being used in constructing a well must be considered as part of the entire system in order to safely and efficiently construct the well.

Many conventional automated drilling systems are "closed loop" systems that attempt to improve the drilling process by sensing a limited number of conditions and adjusting system performance, manually or automatically, based upon the sensed conditions. Often these closed loop systems don't have the ability to monitor or consider the performance of all of the other systems being used or adjust the performance of multiple systems simultaneously. It is therefore left to human intervention to ensure that the entire system operates efficiently/satisfactorily.

Relying on human intervention may become complicated due to the fact that multiple parties are often involved in well construction. For example, constructing a single well will often involve the owner of the well, a drilling contractor tasked with drilling well, and a multitude of other companies that provide specialized tools and services for the construction of the well. Because of the significant coordination and cooperation that is required to integrate multiple systems from multiple companies, significant human intervention is required for efficient operation. Integrating multiple systems and companies becomes increasingly problematic as drilling processes advance in complexity.

Thus, there is a continuing need in the art for methods and apparatus for controlling drilling processes that overcome these and other limitations of the prior art.

BRIEF SUMMARY OF THE DISCLOSURE

Herein disclosed is a drilling control and information system comprising: a rig site network including a drilling equipment controller and a drilling parameter sensor; a downhole sensor communicatively coupled to the rig site network; a data center communicatively coupled to the rig site network; a remote access site communicatively coupled to the data center; and a pressure management application communicatively coupled to the rig site network, wherein the pressure management application receives pressure data from the drilling parameter sensor and the downhole sensor and issues an operating instruction to the drilling equipment controller.

In some embodiments, the drilling parameter sensor measures pump pressure. In some embodiments, the downhole sensor measures downhole pressure at a downhole sensor sub and the downhole sensor is disposed along a drill string. In some embodiments, the drilling equipment controller issues an operating instruction to a mud pump or a choke. In some embodiments, the drilling equipment controller issues an operating instruction to control hoisting of a drill pipe. In some embodiments, the drilling equipment controller issues an operating instruction to a downhole control valve. In some embodiments, the downhole sensor is communicatively coupled to the rig site network via wired drill pipe. In some embodiments, the downhole sensor is communicatively coupled to the rig site network via wireless communication.

Herein also is disclosed a method for controlling pressure in a wellbore comprising: integrating a pressure management application into a rig site network that is communicatively coupled to a downhole sensor, a drilling equipment controller, and a drilling parameter sensor; communicatively coupling the rig site network to a data center and to a remote access site; transmitting pressure data from the downhole sensor and the drilling parameter sensor to the pressure management application; and issuing an operating instruction generated by the pressure management application to the drilling equipment controller, wherein the operating instruction is based on pressure data received from at least one of the downhole sensor or the drilling parameter sensor.

In some embodiments, the drilling parameter sensor measures pump pressure. In some embodiments, the downhole sensor measures downhole pressure at a downhole sensor sub. In some embodiments, the downhole sensor is disposed along a drill string. In some embodiments, the method further comprises issuing the operating instruction from the drilling equipment controller to a mud pump and/or a choke. In some embodiments, the method further comprises issuing the operating instruction from the drilling equipment controller to a downhole control valve. In some embodiments, the method further comprises issuing the operating instruction from the drilling equipment controller to hoisting equipment. In some embodiments, pressure data is transmitted from the downhole sensor to the rig site network via wired drill pipe or wireless communication.

Herein also is disclosed a method for controlling pressure in a wellbore comprising: integrating a pressure management application into a rig site network that is communicatively coupled to a downhole sensor, a drilling equipment controller, and a drilling parameter sensor; communicatively coupling the rig site network to a data center and to a remote access site; transmitting pump pressure data from the drilling parameter sensor to the pressure management application; transmitting downhole pressure data from the downhole sensor to the pressure management application; and processing the pump pressure data and the downhole pressure data with the pressure management application to generate an operating instruction; and issuing the operating instruction to the drilling equipment controller.

In some embodiments, the method further comprises issuing the operating instruction from the drilling equipment controller to a mud pump and/or a choke. In some embodiments, the method further comprises issuing the operating instruction from the drilling equipment controller to a downhole control valve.

BRIEF DESCRIPTION OF THE DRAWINGS

For a more detailed description of the embodiments of the present disclosure, reference will now be made to the accompanying drawings.

DETAILED DESCRIPTION

Figure 1A:
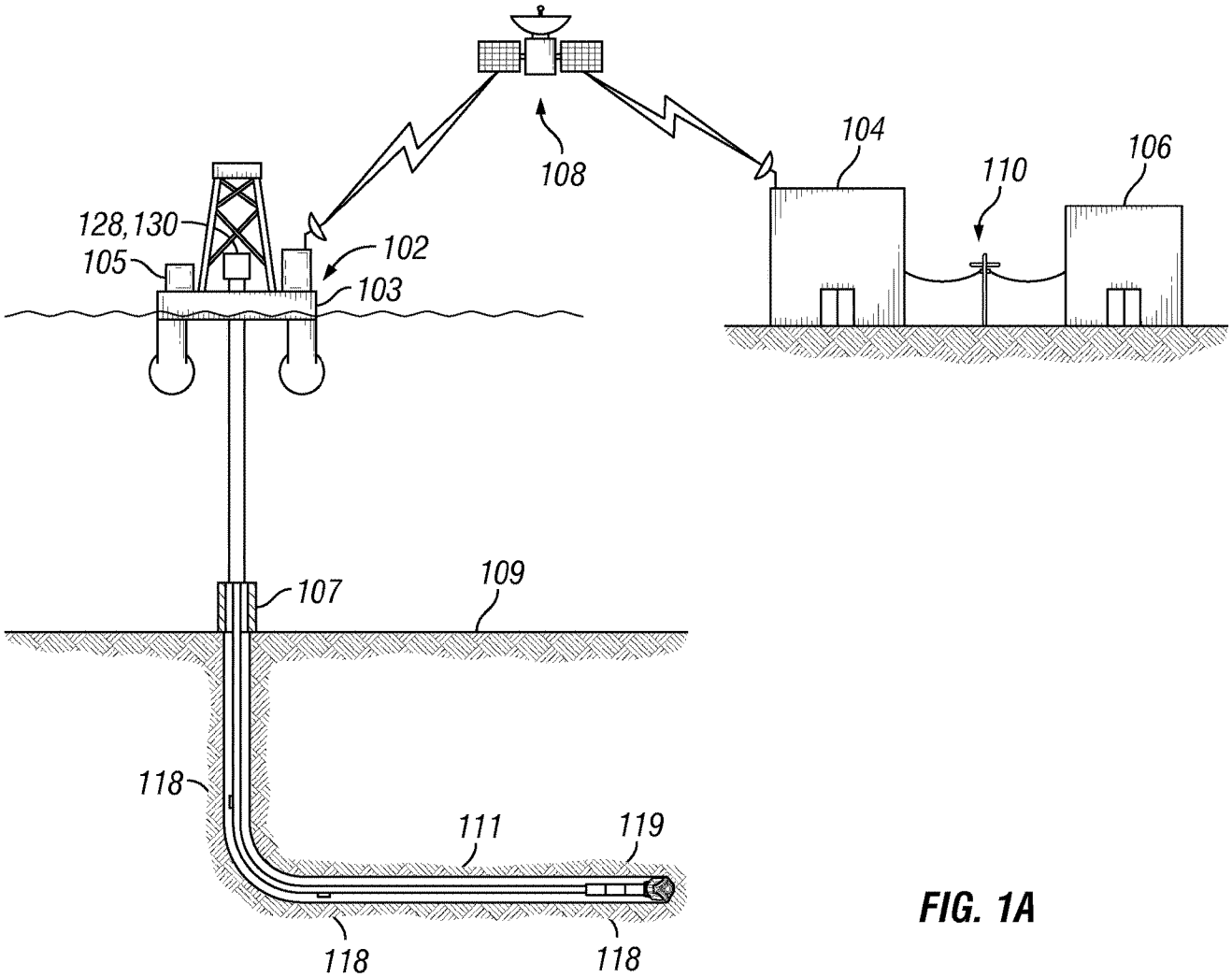
FIGS. 1A and 1B are simplified schematic diagrams of a drilling control and information network.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein. For the purposes of this application, the term "real-time" means without significant delay.

Figure 1B:
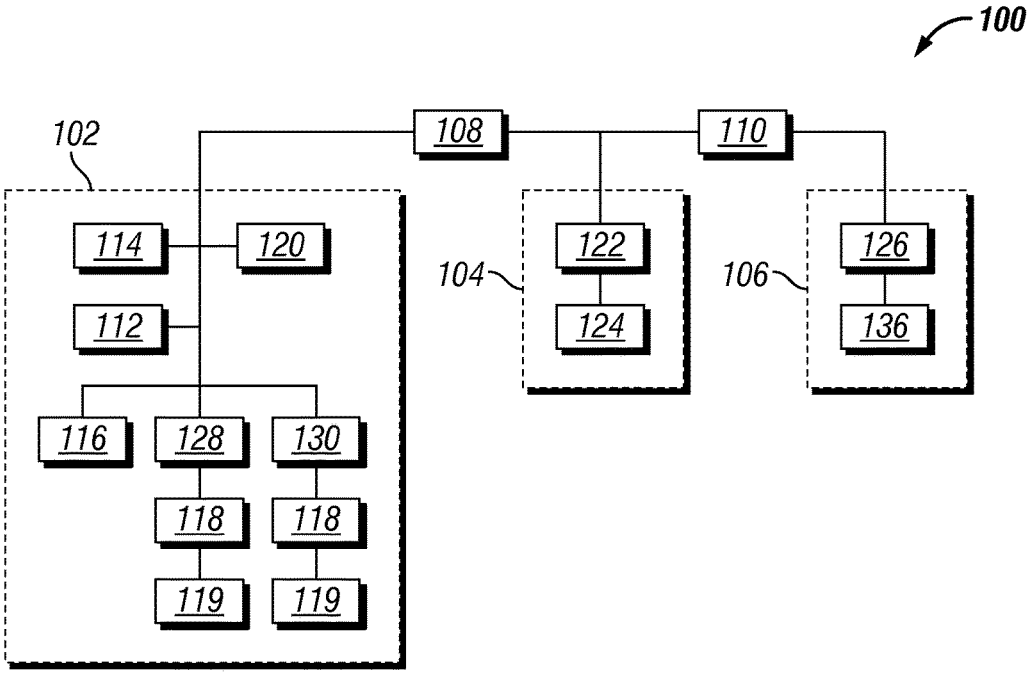

Referring initially to FIGS. 1A and 1B, a drilling control and information network 100 may include a rig site network 102, a data center 104, and a remote access site 106. The rig site network 102 and the remote access site 106 are communicatively coupled to the data center 104 via secure, high-speed communication systems that may provide real-time transmission of data. For example, if the rig site is located offshore, the rig site network 102 may be coupled to the data center 104 via a satellite-based communication system 108. The remote access site 106 may be communicatively coupled to the data center 104 over the Internet 110.

The rig site network 102 is located on a drilling rig 103 and provides connectivity among rig mounted drilling equipment 105, drilling equipment 107 at the seafloor 109, and downhole tools 119 in the wellbore 111. Although illustrated for use with an offshore drilling rig 103 it is understood that the network described herein is equally applicable to land-based drilling rigs. The rig site network 102 may provide information on the performance of the rig and the ability to control the drilling processes taking place. To provide this connectivity, the rig site network 102 may include drilling equipment controllers 112, drilling process controllers 114, drilling parameter sensors 116, downhole sensors 118 and tools 119, and drilling information systems 120. An exemplary rig site network is described in U.S. Pat. No. 6,944,547, which is incorporated by reference herein for all purposes.

The drilling equipment controllers 112 may include the control systems and sub-networks that are operable to directly control various drilling components, including, but not limited to, mud pumps, top drives, draw works, pressure control equipment, pipe handling systems, iron roughnecks, chokes, rotary tables, and motion compensation equipment.

The drilling process controllers 114 include systems that analyze the performance of the drilling system and automatically issue instructions to one or more drilling components so that the drilling system operates within acceptable parameters. The drilling information systems 120 include systems that monitor ongoing drilling processes and provide information as to the performance of the drilling system. This information may be in the form or raw data or may be processed and/or converted by the drilling information systems 120. The information provided by the drilling information systems 120 may be provided to the drilling process controllers 114, may be visually presented for evaluation by rig personnel, or may be accessed and utilized by other processes, such as those that will be discussed in detail to follow.

The drilling parameter sensors 116 may include, but are not limited to, pressure sensors, temperature sensors, position indicators, mud pit monitors, tachometers, and load sensors. The downhole sensors 118 and tools 119 may include sensors mounted at or near the bottom-hole-assembly or at selected points along the drill string. In certain embodiments, multiple sensors may be integrated into a "sensor sub" that may measure temperature, pressure, inclination, rotation, acceleration, tension, compression, and other properties at a selected location in the drill string. The downhole sensors 118 and tools 119 may communicate with the rig site network via wired or wireless communication, which will be discussed in detail to follow.

The rig site network 102 allows data to be collected from the drilling equipment controllers 112, drilling parameter sensors 116, and downhole sensors 118 and tools 119. That data may then processed by the drilling process controllers 114 and/or the drilling information systems 120. Thus, the rig site network 102 may be configured to automatically issue operating instructions to the drilling equipment controllers 112 and/or the downhole tools 118 to control the drilling processes.

The rig site network 102 also allows data to be presented to operations personnel at the rig site by the drilling information systems 120 as well as transmitted in real-time over the network 100 to the data center 104 and remote access sites 106. The data may be analyzed at any or all of these locations to evaluate the performance of the drilling rig and drilling processes. Because high speed communication allows the remote access sites 106 to have real-time communication with the rig site network 102 and real-time visualization of the drilling process, the drilling control and communication network 100 also allows control inputs to be made from the remote access sites 106.

As previously discussed, the data center 104 may be communicatively coupled a rig site network 102 via a secure, high-speed communications system, such as satellite communication system 108. The data center 104 may include one or more rig site information systems 122 and one or more rig site visualization and control systems 124. The rig site information systems 122 may include systems that store data gathered by the rig site network 102 and allow users to access that data to evaluate information including, but not limited to, rig performance, costs, and maintenance needs. The rig site visualization and control systems 124 may include systems that receive data from the rig site network 102 and allow for uses not physically on the rig to monitor the activity on the rig in real-time and issue operating instructions directly to equipment located on the rig. The data center 104 may be communicatively coupled to a plurality of rig site networks 102 so as to enable the monitoring of a plurality of rigs from a central location.

Remote access site 106 may include remote access clients 126 and/or remote process controllers 136 that may access data from the data center 104 or directly from the rig site network 102. The remote access clients 126 and remote process controllers 136 may provide users with the ability to remotely monitor and adjust rig performance. As previously discussed, remote access site 106 may access data center 104, and therefore rig site network 102, over the network 100 from any location.

Providing a real-time data connection between downhole sensors 118 and tools 119 and the rig site network 102 may further enhance the monitoring and management of drilling processes and drilling rigs via drilling control and information network 100. Downhole sensors 118 and tools 119 may provide information regarding downhole conditions and system performance that has been previously unavailable in real-time. In certain embodiments, data from downhole sensors 118 and tools 119 may be transmitted to the surface through wired drill pipe, such as described in U.S. Pat. No. 6,670,880, which is incorporated by reference herein in its entirety. Wired drill pipe includes conductors coupled to the drill pipe that provide a direct link between the surface and the downhole sensors 118 and tools 119. The drill pipe may include electrical conductors, fiber optic conductors, other signal conductors, and combinations thereof. Wired drill pipe systems may include a downhole communication hub that gathers information from one or more downhole tools and then transmits that data along the conductors to a surface communication hub 128 that receives the data and communicates with the rig site network 102. Wired drill pipe may support communication in both directions allowing transmission of data from downhole sensors 118 and tools 119 to the rig site network 102 and transmission of operating instructions from the rig site network to one or more downhole sensors 118 and tools 119.

In other embodiments, data from downhole sensors 118 and tools 119 may be transmitted wirelessly to the surface through signals such as pressure pulse transmitted through the drilling fluid, wireless electromagnetic signals, acoustic signals, or other wireless communication protocols. Tools that may transmit signals through pressure pulses may be configured to transmit pressure pulses continuously or at selected intervals, such as when the pumps are shut off. One embodiment of a downhole tool that is operable to transmit pressure pulses is described in U.S. Published Patent Application 2011/0169655, which is incorporated by reference herein in its entirety.

Wireless communication systems may include a downhole communication hub that gathers information from one or more downhole tools and then transmits that data to a surface communication hub 130 that receives the data and communicates with the rig site network 102. Wireless communication systems may support communication in both directions allowing transmission of data from downhole sensors 118 and tools 119 to the rig site network 102 and transmission of operating instructions from the rig site network to one or more downhole sensors 118 and tools 119.

By supporting communication with downhole sensors 118 and tools 119, the drilling control and information network 100 thus allows visualization and communication between downhole sensors 118, the rig site network 102, the data center 104, and remote access sites 106. The drilling control and information network 100 provides an infrastructure that allows for the utilization information found in the network to control the drilling process or provide enhanced visualization of the drilling process. To support this activity, the drilling control and information network 100 provides an interface that allows various specialized drilling applications to be integrated into the rig site network 102, the data center 104, and/or at remote offices 106 to provide enhanced visualization of the drilling process or allow for autonomous or remote control of certain aspects of the drilling process.

In one or more embodiments, drilling control and information network 100 may include drilling applications designed to monitor one or more sensors and provide operating instructions to one or more components to manage drilling operations. In certain embodiments, the applications may be stand-alone components that are coupled to the rig site network 102, data center 104, or remote access site 106. In other embodiments, the drilling applications may be integrated into one of the components of the network, such as drilling information system 120, rig site visualization and control system 124, and/or remote process controllers 136. Drilling applications may also be designed to operate autonomously or with operator input. The drilling applications may be designed to operate with one or more tools, operations, processes, and/or external interfaces. Many different drilling processes and types of drilling information can be managed by drilling applications, including, but not limited to wellbore pressure management, kick detection and mitigation, drilling control and optimization, wellbore monitoring, equipment monitoring, and wellbore visualization.

Managing pressure within the wellbore is critical for many aspects of well construction, including, but not limited to, rate of penetration (ROP), hole cleaning, and management of formation pressures and fracture gradients. The hydrostatic pressure within a wellbore is determined by the depth of the wellbore, the weight of the drilling fluid, the dynamic pressure generated by the mud pumps, and, in certain operations, backpressure applied by a choke. The downhole sensors 118 and tools 119 of the rig site network 102 may be used to collect real-time pressure data from one or more locations within a wellbore. This pressure data may then be analyzed by one or more applications integrated into the drilling control and information network 100 to adjust one or more of the variables that may affect wellbore pressure.

Figure 2:
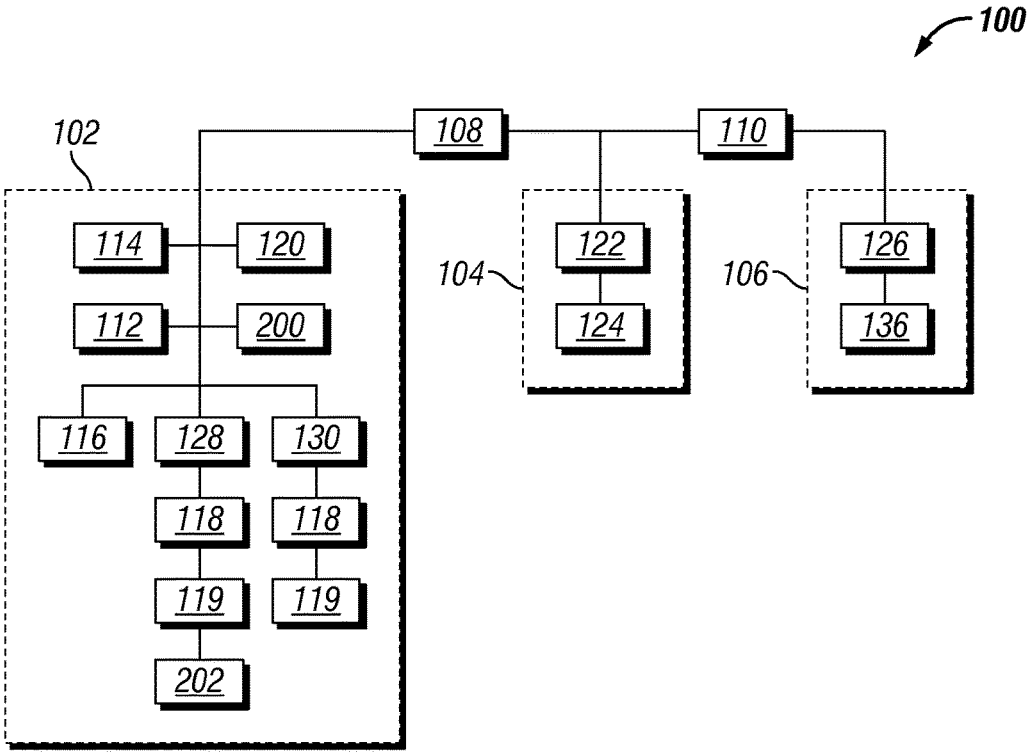
FIG. 2 is a simplified schematic diagram of the drilling control and information network of FIG. 1 including a pump pressure management application.

Referring now to FIG. 2, a pump pressure management application 200 is communicatively coupled to the rig site network 102. By controlling the fluid pressure being pumped into the wellbore and the monitoring the pressure returning to the surface at the drillstring, the choke/kill lines, or at another desired location, pressure variations may be used to evaluate hole cleaning, wellbore stability, and other flow issues. The pump pressure management application 200 receives downhole pressure data from downhole sensors 202 located along the drill string and pump pressure data from drilling information system 120. Application 200 may be configured to issue operating instructions to the mud pumps (not shown) via a drilling equipment controller 112 and/or drilling process controller 114 so as to regulate pressure to a predetermined set-point either at selected location at the surface or in the wellbore. Application 200 may also be configured to regulate the mud pumps during pump start-up, or ramping, so that pressure is increased in a controlled manner. In some embodiments, application 200 may analyze the pressure data from surface and downhole sensors in order to make additional adjustments or provide an indication of wellbore conditions such as hole cleaning and kick detection. For example, application 200 may monitor the correlation between pump pressure, surface pressure, and downhole pressure during a series of pump starts to provide an indication of wellbore conditions. The pressure data received by application 200 may be archived and an algorithm built into the application 200 may analyze changes to the pressure data over time to identify trends and anomalies that may indicate the status of the well. Drilling control and information network 100 may also allow remote monitoring and adjustment of the pump pressure management application 200 from data center 104 and/or remote site access 106.

Figure 3:
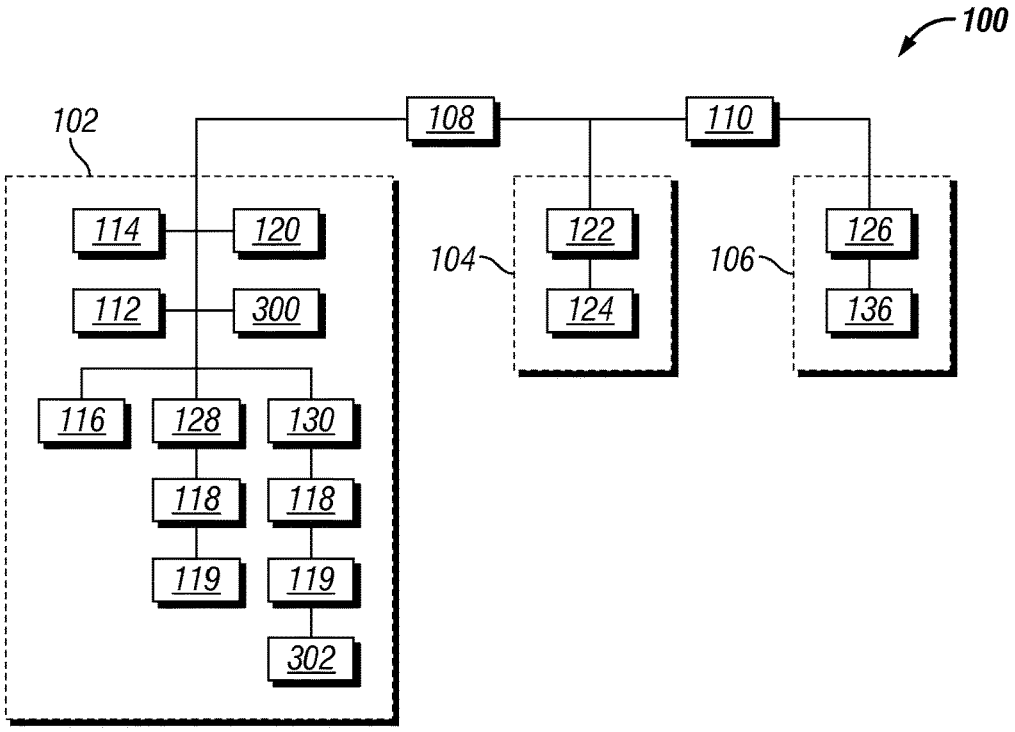
FIG. 3 is a simplified schematic diagram of the drilling control and information network of FIG. 1 including an alternative pump pressure management application.

Referring now to FIG. 3, an alternative pump pressure management application 300 is communicatively coupled to the rig site network 102 and may be used to manage mud pump start pressures. Similar to pump pressure management application 200, application 300 receives downhole pressure data from downhole sensors 202 located along the drill string and pump pressure data from drilling information system 120. Application 300 activates the mud pumps via a drilling equipment controller 112 and/or drilling process controller 114 and issues control commands to a downhole flow valve 302 that may be used to precisely manage the flow of fluid from the drillpipe into the wellbore so that pressure enters the wellbore in a smooth, consistent manner and dampens pressure spikes that may result from activating the mud pumps. The pressure data received by application 300 may be archived and an algorithm built into the application 300 may analyze changes to the pressure data over time to identify trends and anomalies that may indicate the status of the well. Drilling control and information network 100 also allows remote monitoring and adjustment of the pump pressure management application 300 from data center 104 and/or remote site access 106.

As previously discussed, the downhole flow valve 302 may similar to the valve disclosed in U.S. Published Patent Application 2011/0169655, which is incorporated by reference herein for all purposes. The downhole valve 302 may also be used to facilitate wireless communication with rig site network 102 by transmitting pressure pulses to the surface that carry information collected by one or more downhole dynamic sensors, such as acceleration, RPM, pressure, etc. This data may be used to determine bit whirl, stick/slip. The operation of the downhole valve may operated in different modes to transmit various data on each connection. This near real-time data may be used to modify drilling parameters.

Figure 4:
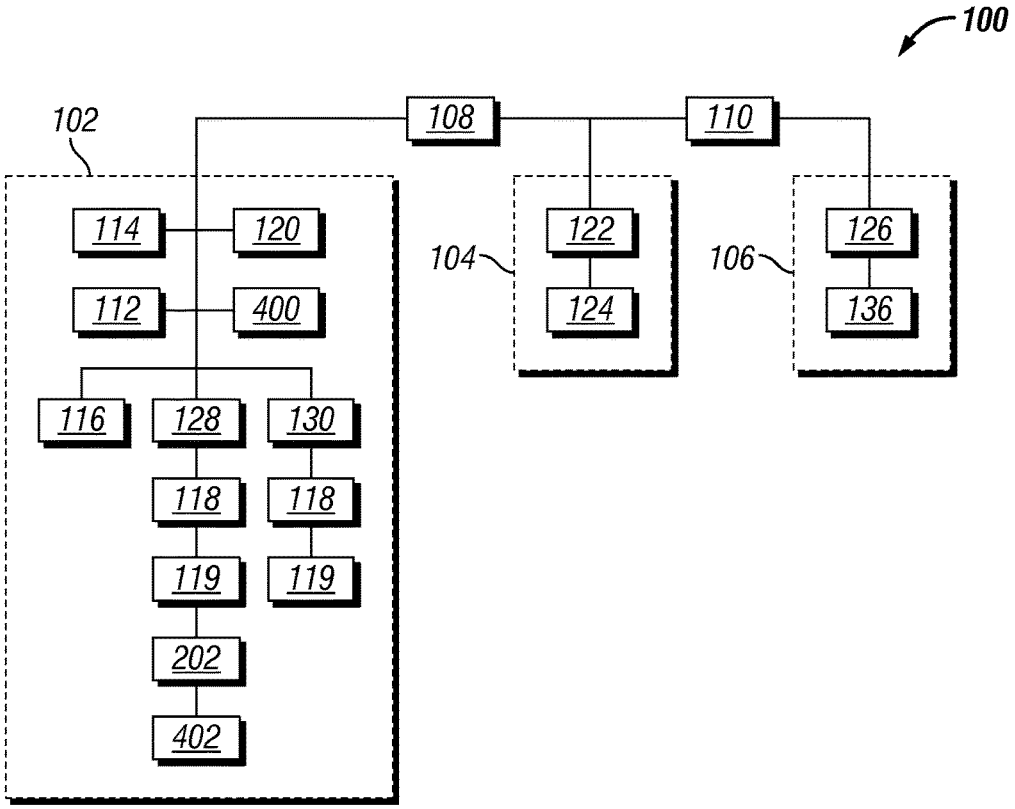
FIG. 4 is a simplified schematic diagram of the drilling control and information network of FIG. 1 including a surge/swab management application.

Referring now to FIG. 4, a surge/swab management application 400 is communicatively coupled to the rig site network 102. Surge pressures and swab pressures are a pressures generated in a wellbore from the movement of drill pipe. Surge pressures are increased wellbore pressures generated when additional pipe is inserted into a wellbore while swab pressures are decreased wellbore pressures resulting from the removal of drill pipe from a wellbore. Surge and swab pressures may lead to kicks and to wellbore stability problems if not properly managed. Application 400 receives downhole pressure data from a downhole sensor sub 402, drill string mounted sensors 202, and drill pipe position data from drilling information system 120. As the drill pipe is moved, the surge/swab management application 400 may adjust the operation of the pumps via a drilling equipment controller 112 and/or drilling process controller 114 to compensate for movement of the drill pipe. For example, when hoisting, the surge/swab management application 400 may increase pumping rate so that a pulse of mud is transmitted in a manner that offsets the pressure wave associated with the hoisting process. The pumps may be slowed when drill pipe is run into the wellbore. Application 400 may also modulate the speed at which drill pipe is run into or out of the wellbore in response to pressure data received from the downhole sensor sub 402. Drilling control and information network 100 also allows remote monitoring and adjustment of the pump pressure management application 400 from data center 104 and/or remote site access 106.

Figure 5:
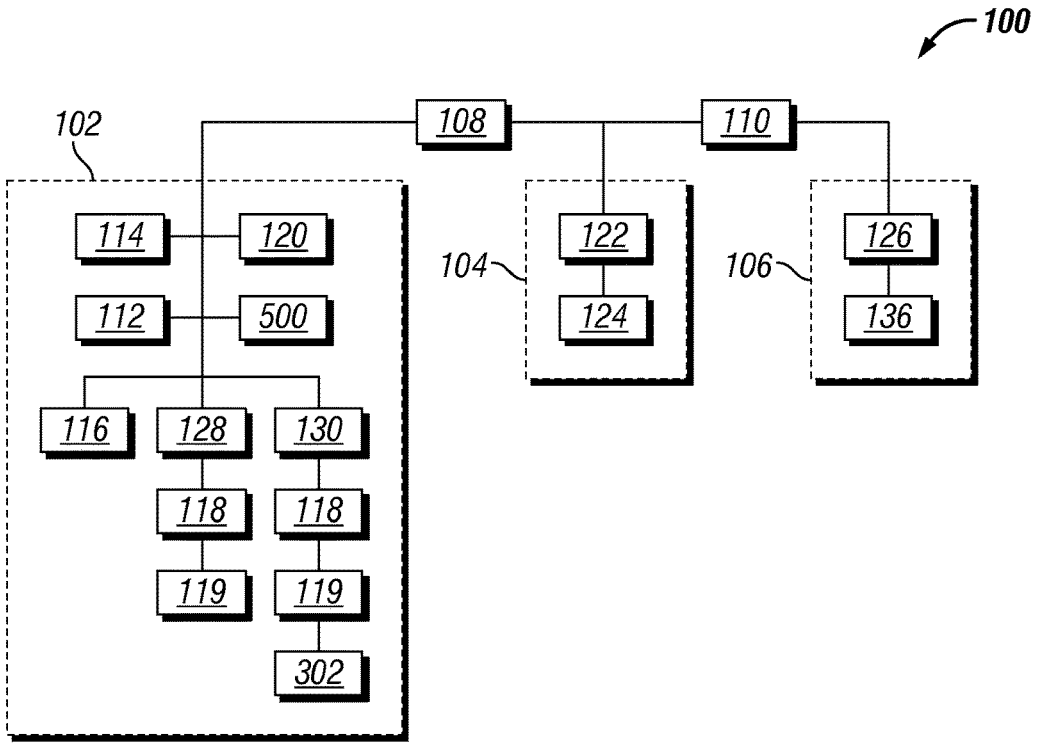
FIG. 5 is a simplified schematic diagram of the drilling control and information network of FIG. 1 including an alternative surge swab management application.

FIG. 5 illustrates an alternative surge/swab management application 500 that is communicatively coupled to the rig site network 102 and utilizes a downhole valve 302 to control surge and swab pressure variations. Application 500 may issue operating instructions to the downhole valve 302 so as to increase or decrease the fluid entering the wellbore so as to manage pressure spikes to minimize effects of pressure spikes from pump startup, and pressure surge and swab during hoisting operations. Application 500 may also be configured to issue operating instructions to the mud pumps and/or hoisting equipment via drilling equipment controller 112 and/or drilling process controller 114 to further control downhole wellbore pressures. Drilling control and information network 100 also allows remote monitoring and adjustment of the pump pressure management application 500 from data center 104 and/or remote site access 106.

Figure 6:
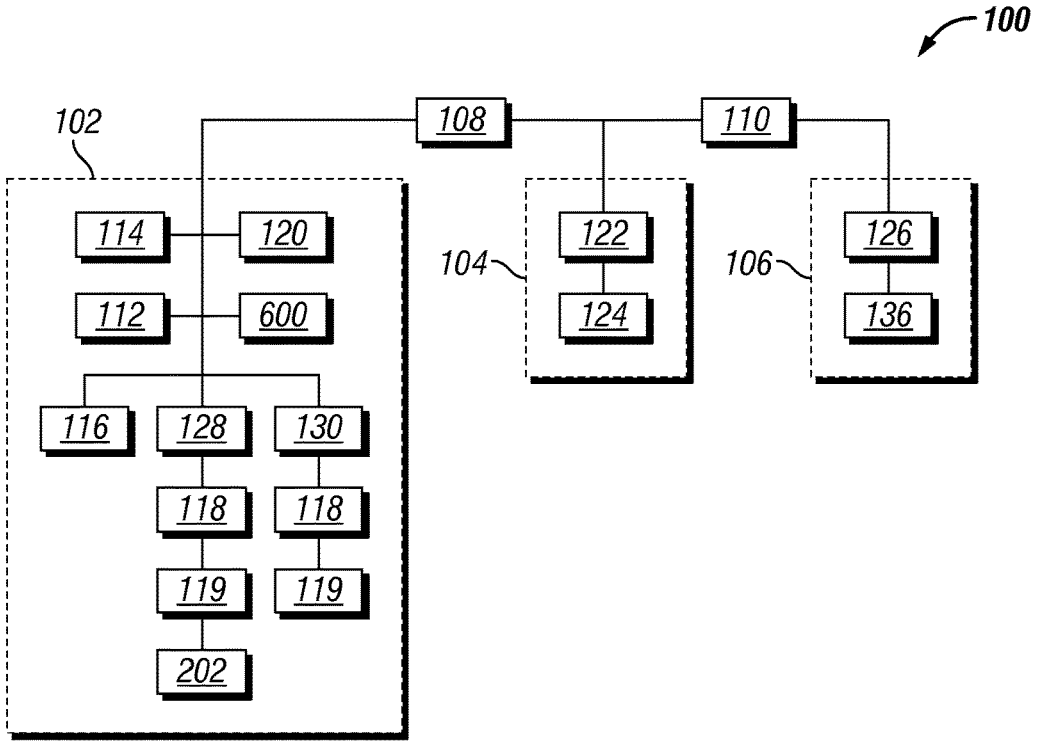
FIG. 6 is a simplified schematic diagram of the drilling control and information network of FIG. 1 including a managed pressure drilling application.

FIG. 6 illustrates a managed pressure drilling (MPD) application 600 that is communicatively coupled to the rig site network 102. In managed pressure drilling, the pressure within the wellbore is maintained in an unbalanced state where pressure in the formation is greater than the pressure within the wellbore. Drilling in an underbalanced state increases drilling rates but also requires a heightened state of control of wellbore pressures so as to prevent kicks or other pressure control situations. The MPD application 600 may receive real-time pressure data from sensor sub 402 and drill string mounted pressure sensors 202 to monitor the pressure within in the wellbore. Because the rig site network 102 allows for real time pressure measurement from within the wellbore, the MPD application 600 may be configured to issue operating instructions to drilling equipment, such as a choke, a continuous circulating sub, mud pumps, and other pressure control equipment, via a drilling equipment controller 112 and/or drilling process controller 114 so as to maintain the wellbore pressure within a desired range. Drilling control and information network 100 also allows remote monitoring and adjustment of the MPD application 600 from data center 104 and/or remote site access 106.

Figure 7:
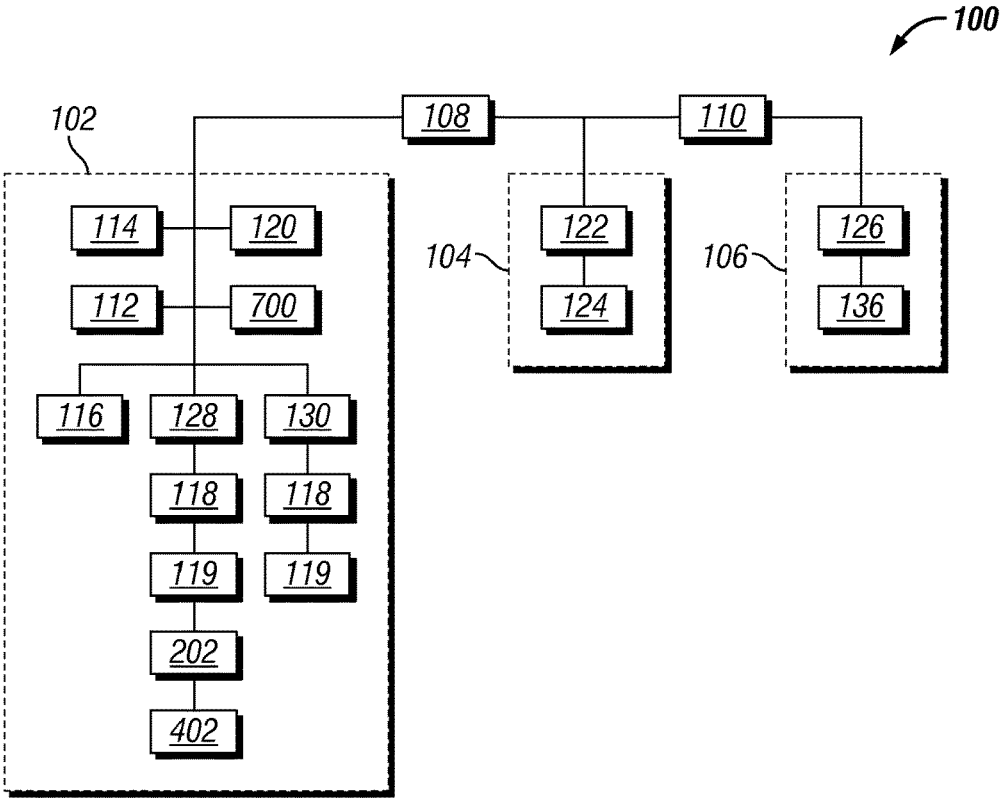
FIG. 7 is a simplified schematic diagram of the drilling control and information network of FIG. 1 including a dual gradient drilling application.

FIG. 7 illustrates a dual gradient (DG) drilling application 700 that is communicatively coupled to the rig site network 102 and is configured for use in dual gradient drilling operations. Dual gradient drilling is used in offshore drilling operations to reduce the wellbore pressure by introducing a lower density fluid into the column of drilling fluid. This is often accomplished by injecting a lower density drilling fluid, or seawater, into the riser above the wellhead. The DG drilling application 700 may receive real-time pressure data from sensor sub 402 and drill string mounted pressure sensors 202 to monitor the pressure within in the wellbore. The application 700 may also monitor pump and standpipe pressures and flow rates via drilling information system 120. DG drilling application 700 may be configured to monitor these pressure and flow rate data and issue operating instructions to drilling equipment, such as chokes, mud pumps, mud cleaning equipment, and/or other pressure control equipment, via a drilling equipment controller 112 and/or drilling process controller 114 so as to maintain the wellbore pressure within a desired range. Drilling control and information network 100 also allows remote monitoring and adjustment of the DG drilling application 700 from data center 104 and/or remote site access 106.

Figure 8:
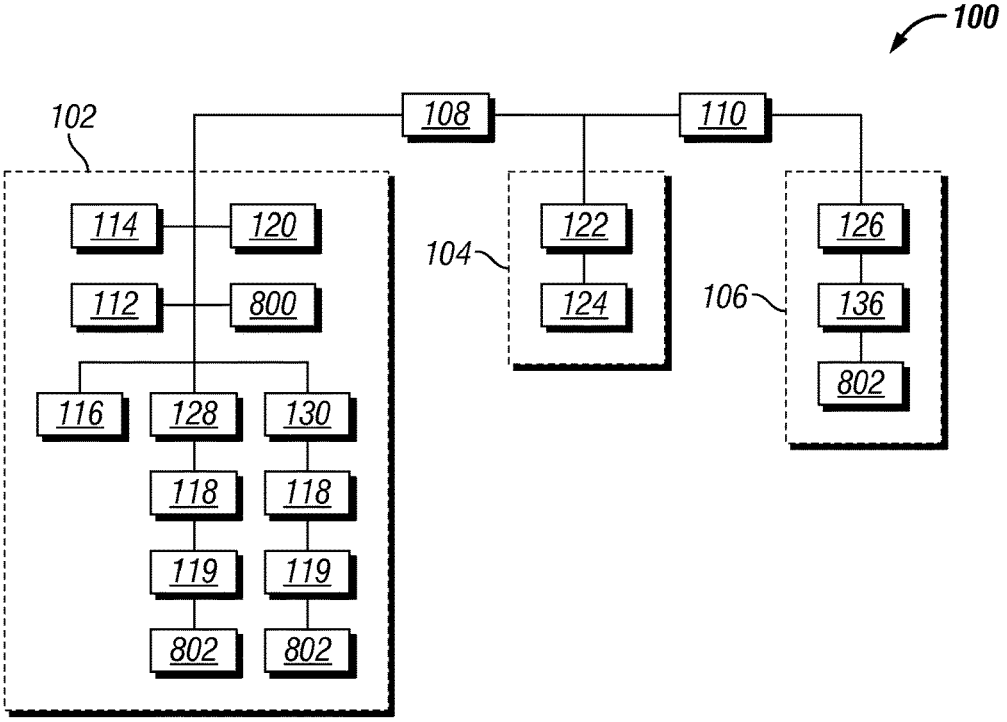
FIG. 8 is a simplified schematic diagram of the drilling control and information network of FIG. 1 including a directional drilling application.

FIG. 8 illustrates a directional drilling application 800 that is communicatively coupled to the rig site network 102 and may be configured to automate directional drilling operations. In directional drilling operations, the drill string is guided along a non-vertical path to reach a very specific target zone. In operation, downhole directional drilling tools 802, such as rotary steerable tools, provide data to the rig site network 102 that indicates the performance of the downhole tools. The directional drilling application 800 evaluates the performance of the downhole tools against the well plan that the application either stores in local memory or may access through the rig site network 102. The application 800 compares the position and performance of the directional drilling tools against the well plan, which includes the path the well should be following and the expected performance parameters. The application 800 may the provide operating instructions to the downhole direction drilling tools 802 or to surface equipment, such as the top drive, via drilling equipment controllers 112 so as to bring the position and performance of the directional drilling tools 802 into compliance with the drilling plan. The application 800 may continuously monitor the performance of the directional drilling tools 802 to make further adjustments as the performance of the tools comes into compliance with the drilling plan. Real time well data management allows communication with a remote directional drilling application 804 at the remote access site 106 so that personnel located away from the rig site may make other inputs and adjustments in reaction to the performance of the system.

Figure 9:
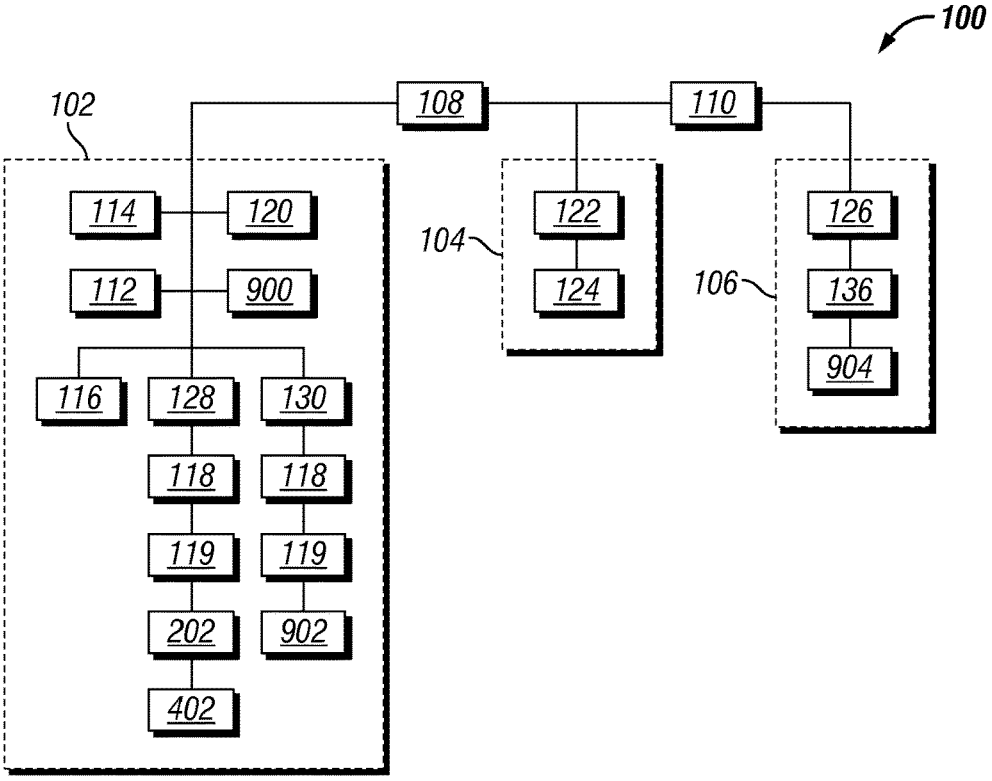
FIG. 9 is a simplified schematic diagram of the drilling control and information network of FIG. 1 including a wellbore visualization application.

FIG. 9 illustrates a wellbore visualization application 900 that is communicatively coupled to the rig site network 102. Wellbore visualization may provide users with important information regarding the wellbore being constructed and give early indications of potential problems with the wellbore. The wellbore visualization application 900 is operable to provide real-time wellbore visualization by acquiring real-time measurements of depth, hole size, pressure, orientation, etc. from drill string sensors 202, a downhole sensor sub 402, logging while drilling tools 902, and drilling parameter sensors 116 via drilling information system 120. The wellbore visualization application 900 takes the acquired data and generates a three-dimensional simulation of the wellbore that may be compared to the intended well plan and/or provide early indications of wellbore stability problems that may then be addressed using other control components to vary drilling parameters, such as mud weight, pressure, and weight on bit, via drilling equipment controllers 112. The wellbore visualization application 900 allows communication with a remote visualization application 904 at the remote access site 106 so that personnel located away from the rig site may make other inputs and adjustments in reaction to the performance of the system.

In certain embodiments, the wellbore visualization application 900 may be used in conjunction with downhole operations, such as underreaming. For example, bottom hole assembly including a downhole sensor sub 402 could also include an underreamer. As the downhole sensor sub 402 travels through the wellbore, it can transmit real-time measurements of the depth and hoe size to the wellbore visualization application 900. The wellbore visualization application 900 may be configured to compare the measured depth and hole size to a predetermined well plan so that if the hole size is smaller than planned, the underreamer can be deployed to increase the size of the wellbore.

Figure 10:
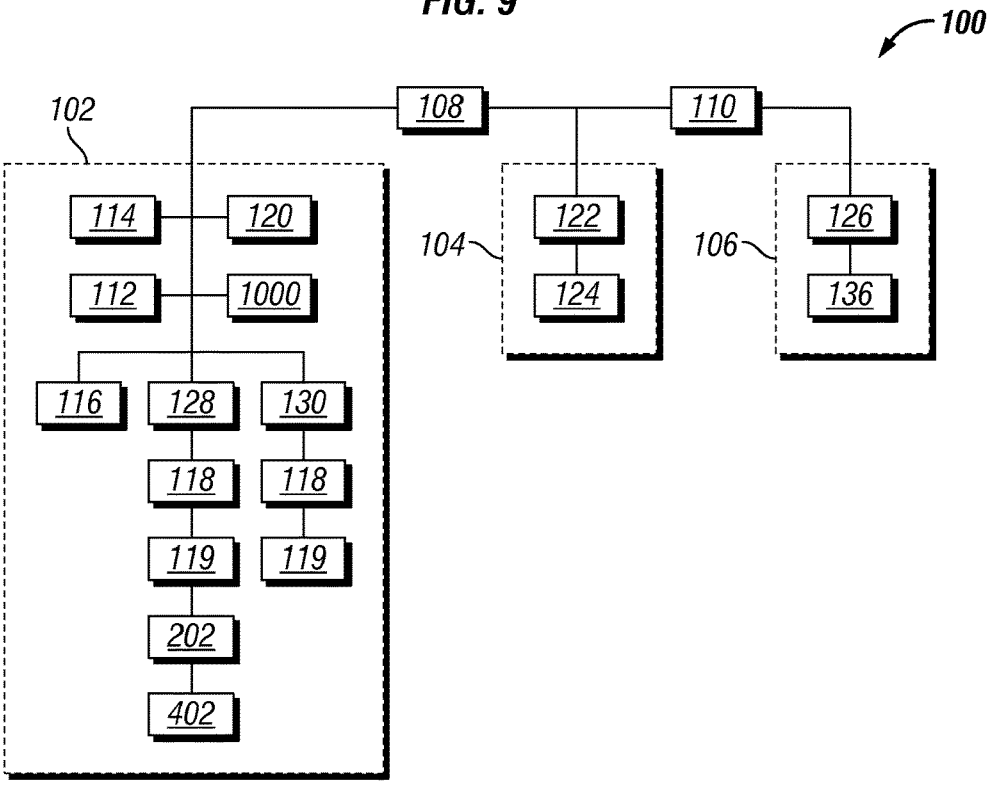
FIG. 10 is a simplified schematic diagram of the drilling control and information network of FIG. 1 including a drilling oscillation application.

FIG. 10 illustrates a drilling oscillation application 1000 that is communicatively coupled to the rig site network 102. As is discussed in International Publication No. WO 2011/035280, which is incorporated by reference herein for all purposes. The efficiency of a number of drilling processes may be negatively impacted by steady state conditions. For example, pumping at constant rate may create flow conditions that inhibit hole cleaning, while varying pump rate within narrow range may reduce these problems. In order to address this problem, the drilling oscillation application 1000 monitors drilling process data acquired by drill string sensors 102, downhole sensor sub 402, and drilling parameter sensors 116 via drilling information system 120. The application 1000 is operable to provide control inputs to drilling equipment controllers 112 to oscillate set points for RPM, pressure, and WOB. This oscillation helps decrease problems associated with steady state conditions.

Figure 11:
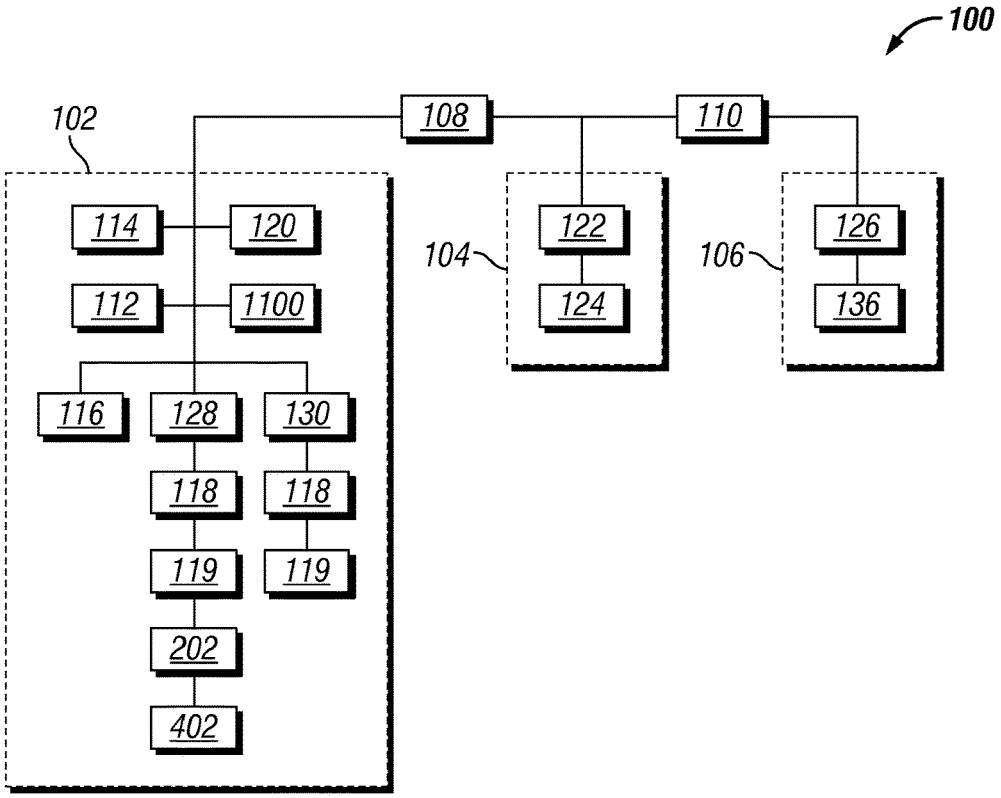
FIG. 11 is a simplified schematic diagram of the drilling control and information network of FIG. 1 including a total vertical depth application.

FIG. 11 illustrates a true vertical depth (TVD) application 1100 that is communicatively coupled to the rig site network 102. Determining the true vertical depth of the bottom hole assembly is very important, especially in directional wells and shale plays where the production zone may be relatively narrow. The depth of the bottom hole assembly is conventionally calculated by tracking the length of drill string that has been run into the wellbore. Because the drill string is not rigid there is inherent error built into this calculation. The TVD application 1100 receives pressure measurements from drill string sensors 202 and/or a downhole sensor sub 404 and drilling fluid density measurements from the drilling parameter sensors 116 via drilling information system 120. The TVD application 1100 calculates the true vertical depth based on the measured density and pressure data. Acquiring pressure data both with the pumps on and off may enhance accuracy of the determination of true vertical depth.

Figure 12:
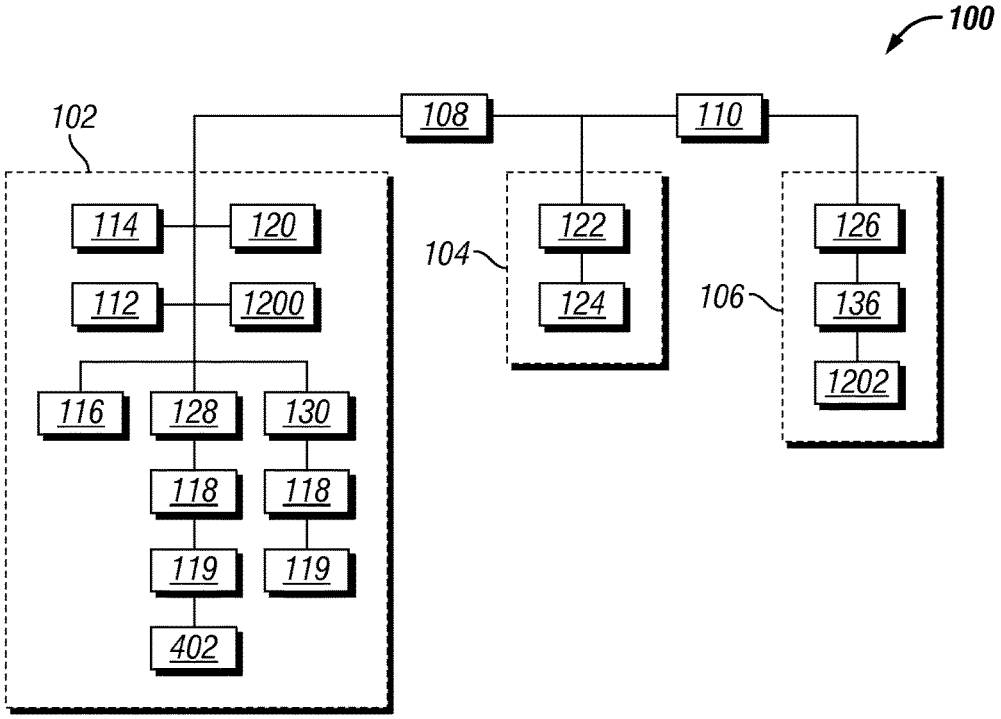
FIG. 12 is a simplified schematic diagram of the drilling control and information network of FIG. 1 including a geology and geophysics application.

FIG. 12 illustrates a geology and geophysics (G&G) application 1200 that is communicatively coupled to rig sit network 102. The G&G application 1200 may communicate with a remote G&G package 1202 connected to remote access site 106 to integrate geology and geophysical databases into a well plan to determine drilling envelope. The G&G application 1200 may provide feedback and control instructions to well equipment controllers 112 based on parameters drawn from the geology and geophysical databases. The G&G application 1200 may also acquire formation data from a downhole sensor sub 402 and drilling parameter sensors 116 that may be communicated to the G&G package and used to update the geology and geophysical databases. This formation data may also be stored and analyzed by rig site information systems 122 and rig site visualization and control systems 124 at the data center 104 so that the information may be integrated into updated well plans.

Figure 13:
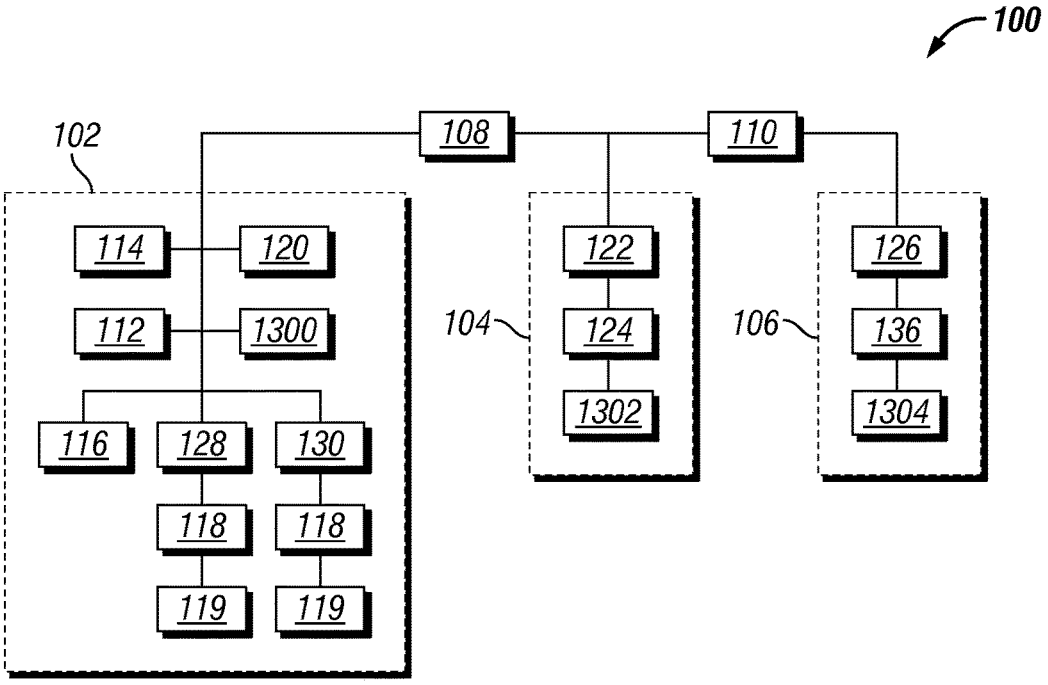
FIG. 13 is a simplified schematic diagram of the drilling control and information network of FIG. 1 including an equipment health application.

FIG. 13 illustrates an equipment health monitoring system 1300 that is communicatively coupled to the rig site network 102. An exemplary health monitoring system for use with surface equipment is disclosed in U.S. Pat. No. 6,907,375, which is incorporated by reference herein for all purposes. The equipment health monitoring system 1300 is operable receive real-time downhole tool performance and health data from downhole tools and sensors 118, which may be used to determine when a replacement is needed. The equipment health monitoring system 1300 may communicate this performance and data to a service center 1302 at the data center 104 and to an external portal 1304 at the remote access site 106 to allow supply chain to get spare parts and/or new tools to the rig site.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A drilling information system for use with one or more drilling rigs, the drilling information system comprising:

a rig site network including a drilling equipment controller, drilling parameter sensors, and a drilling information system configured to provide drilling data indicating the performance and health of drilling equipment;

downhole sensors communicatively coupled to the rig site network, the downhole sensors providing downhole data indicating health, performance and position of a downhole tool;

a data center communicatively coupled to the rig site network, wherein the data center is remote from the rig site network, and wherein the data center is operable to store the drilling data, the downhole data, and a well plan that includes a path a well should be following and expected performance parameters;

a remote access site communicatively coupled to the data center and operable to access data stored in the data center; and a plurality of applications communicatively coupled to the rig site network, wherein the plurality of applications comprises a drilling application that is operable to receive the performance data and the position data from the downhole sensors, the drilling application having access to the well plan, the drilling application being operable to compare the position and performance of the downhole tool against the well plan, wherein the plurality of applications comprises a wellbore visualization application that is operable to acquire the data from the drilling parameter sensors and the downhole sensors, and to generate a three-dimensional simulation of the well for comparison with the well plan, wherein the plurality of applications comprises an equipment health monitoring application that is operable to receive the performance data and the health data from the drilling parameter sensors and from the downhole sensors, and to determine from the performance and health data a time when spare parts or new tools are needed, wherein the drilling application generates operating instructions to the downhole tool or to drilling equipment so as to bring the position and performance of the downhole tool into compliance with the well plan, wherein the remote access site comprises an external portal and the equipment health monitoring application communicates the performance and health data to the external portal, and wherein the wellbore visualization application allows communication with a remote visualization application at the remote access site so that personnel located away from the rig site network can make adjustments in reaction to the performance data, whereby the performance and a life of the drilling equipment and the downhole tool are used to efficiently construct the well.

2. The system of claim 1, further comprising:

a plurality of rig site networks each including a drilling equipment controller and a drilling parameter sensor, wherein each of the plurality of rig site networks is associated with a different rig; and a plurality of downhole sensors each communicatively coupled to one of the plurality of the rig site networks;

wherein the data center that is located remotely from the plurality of rig site networks, wherein each of the plurality of rig site networks is communicatively coupled to the data center, wherein the data center is operable to monitor performance and health data received from each of the plurality of the rig site networks, wherein the equipment health monitoring application is communicatively coupled to each of the plurality of rig site networks, wherein the equipment health monitoring application receives the performance and health data from each of the plurality of the rig site networks, and stores the received performance and health data in the data center, wherein the external portal of the remote access site receives the performance and health data stored in the data center, and generates and issues a control input to the equipment health monitoring application, and wherein the control input includes an indication that a replacement part is needed.

3. The system of claim 2, wherein the data received by the data center from the plurality of rig site networks is generated by the drilling equipment controller or the drilling parameter sensor.

4. The system of claim 2, wherein the data center is communicatively coupled to the plurality of rig site networks via a satellite-based communication system.

5. The system of claim 4, further comprising a plurality of remote access sites, wherein each of the plurality of remote access sites is communicatively coupled to the data center over the Internet.

6. The system of claim 1, wherein the downhole sensors are disposed along a drill string.

7. The system of claim 1, wherein the downhole sensors are communicatively coupled to the rig site network via wired drill pipe.

8. The system of claim 1, wherein the downhole sensors are communicatively coupled to the rig site network via wireless communication.

9. A method for monitoring drilling equipment used by one or more drilling rigs, the method comprising:

integrating a plurality of applications into a rig site network that is communicatively coupled to downhole sensors, a drilling equipment controller, and drilling parameter sensors, wherein the plurality of applications comprises a drilling application, a wellbore visualization application, and an equipment health monitoring application;

wherein the drilling application is operable to receive performance data and position data from the downhole sensors, the drilling application having access to a well plan, the drilling application being operable to compare position and performance of a downhole tool against the well plan, wherein the wellbore visualization application is operable to acquire data from the drilling parameter sensors and the downhole sensors, and to generate a three-dimensional simulation of a well for comparison with the well plan, communicatively coupling the rig site network to a data center and to a remote access site, wherein the data center is remote from the rig site network, and wherein the data center is operable to store the well plan, which includes a path the well should be following and expected performance parameters;

storing data gathered by the rig site network on a rig site information system included in the data center;

determining a position of a drill string using the data received by the drilling application; and transmitting the position of the drill string to the remote access site;

transmitting the performance and health data from the downhole sensors and the drilling parameter sensors to the equipment health monitoring application;

determining from the performance and health data a time when replacement tools or spare parts are needed;

communicating the performance and health data to the remote access site;

generating a control input by comparing the wellbore simulation to the well plan;

providing remote process controllers at the remote access site to adjust rig performance; and using the drilling application to generate operating instructions to the downhole tool or to drilling equipment so as to bring the position and performance of the downhole tool into compliance with the well plan, whereby the performance and a life of the drilling equipment and the downhole tool are used to efficiently construct the well.

10. The method of claim 9, further comprising:

integrating the equipment health monitoring application into a plurality of rig site networks each associated with a different rig, each of the plurality of rig site networks communicatively coupling a downhole sensor, a drilling equipment controller, and a drilling parameter sensor;

communicatively coupling each of the plurality of rig site networks to the remote access site and to the data center that is located remotely from the plurality of rig site networks;

transmitting performance and health data from each of the plurality of the rig site networks to the equipment health monitoring application and to an external portal of the remote access site;

storing, with the equipment health monitoring application, the transmitted data at the data center;

monitoring the performance and health data received from each of the plurality of the rig site networks from the data center, and transmitting a control input from the remote access site to the equipment health monitoring application, wherein the control input includes an indication that a replacement part is needed.

11. The method of claim 9, wherein the downhole sensors are disposed along the drill string.

12. The method of claim 9, wherein the downhole sensors are communicatively coupled to the rig site network via wired drill pipe.

13. The method of claim 9, wherein the downhole sensors are communicatively coupled to the rig site network via wireless communication.

* * * * *